US005149256A

United States Patent [19]

Schmitz

[11] Patent Number: 5,149,256

[45] Date of Patent: Sep. 22, 1992

[54] ROTARY, POSITIVE DISPLACEMENT MACHINE WITH SPECIFIC LOBED ROTOR PROFILE

[75] Inventor: Lothar P. Schmitz, Leeds, England

[73] Assignee: The Drum Engineering Company Limited, England

[21] Appl. No.: 691,495

[22] Filed: Apr. 25, 1991

[30] Foreign Application Priority Data

May 5, 1990 [GB] United Kingdom ..... 9010211

[51] Int. Cl.[5] ..... F04C 18/20

[52] U.S. Cl. ..... 418/150; 418/191

[58] Field of Search ..... 418/150, 191

[56] References Cited

U.S. PATENT DOCUMENTS

| | | | |
|---|---|---|---|
| 3,790,315 | 2/1974 | Emanuelsson et al. | 418/191 |
| 4,138,848 | 2/1979 | Bates | 418/191 |
| 4,224,016 | 9/1980 | Brown | 418/191 |
| 4,324,538 | 4/1982 | Brown | 418/191 |
| 4,430,050 | 2/1984 | Blazejewski | 418/191 |

FOREIGN PATENT DOCUMENTS

| | | | |
|---|---|---|---|
| 2113767 | 8/1983 | United Kingdom | 418/191 |

*Primary Examiner*—Richard A. Bertsch
*Assistant Examiner*—David L. Cavanaugh
*Attorney, Agent, or Firm*—Staas & Halsey

[57] ABSTRACT

A rotary positive-displacement machine of the type having intermeshing lobed rotors, comprising first and second two-lobed rotors mounted respectively in the two housing bores for synchronous rotation. The first, valve rotor has a hub portion which periodically occludes an outlet port to control the generation and discharge of high pressure fluid from the housing. Each lobe of the valve rotor has a leading tip portion which is radiussed so that it does not define a sharp edge. Each lobe also has an outer flank, a major portion of which is a convex curve, which is generated to correspond to the form of the tip of the second, displacement rotor and which merges with a convex arcuate portion whose center is offset from the valve rotor axis. Furthermore, each lobe has a trailing flank formed by a convex curve, generated to correspond to the form of the tip of the displacement rotor, which merges with a convex arcuate portion, whose center is offset from the valve rotor axis, followed directly by a concave arcuate portion whose center is also offset from the valve rotor axis.

4 Claims, 5 Drawing Sheets

16

PRIOR ART

DRUM

ROTARY, POSITIVE DISPLACEMENT MACHINE WITH SPECIFIC LOBED ROTOR PROFILE

BACKGROUND OF THE INVENTION

1. Field of the Invention

The present invention relates to rotary, positive displacement machines of the type having two intermeshing lobed rotors operating within a pair of parallel intersecting cylindrical bores in a chamber.

2. Description of the Related Art

A large variety of such machines are already known, see for example UK 2113767B, U.S. Pat. No. 4,324,538 and U.S. Pat. No. 4,224,016. Machines of this type have the advantage that the lobed rotors mesh without contact so that no lubrication is required in the compression chamber and compressed gas is delivered oil and contaminant free. These machines are therefore useful for application as gas compressors, expanders, pumps and the like.

SUMMARY OF THE INVENTION

It is an object of the present invention to improve on the efficiency of known machines of this type. In particular, it is required to find a means of (a) increasing the displacement volume of the machine for a given size of overall chamber envelope; (b) to enable sharp points on the rotors to be eliminated and (c) to enable inlet and outlet port sizes to be maximised for a given rotor spacing.

In accordance with the present invention, there is provided a rotary positive-displacement machine of the type having intermeshing lobed rotors, comprising:

a housing having two parallel cylindrical intersecting bores defined therewithin;

an inlet port communicating with said two bores for the introduction of low pressure fluid to the housing;

an outlet port formed in one or both end walls of the housing for the discharging of high pressure fluid from the housing;

first and second two-lobed rotors mounted respectively in the two bores for synchronous rotation;

said first rotor having a hub portion which periodically occludes said outlet port to control the generation and discharge of high pressure fluid from the housing;

each lobe of said first rotor having a leading tip portion which is radiussed so that it does not define a sharp edge;

each lobe having an outer flank, a major portion of which is a convex curve, which is generated to correspond to the form of the tip of the second rotor and which merges with a convex arcuate portion whose centre is offset from the first rotor axis; and each lobe having a trailing flank formed by a convex curve, generated to correspond to the form of the tip of the second rotor, which merges with a convex arcuate portion, whose centre is offset from the first rotor axis, followed directly by a concave arcuate portion whose centre is also offset from the first rotor axis.

The benefit of increasing the displacement volume of the machine for a given size of overall chamber envelope and a given set of clearances between rotary and stationary components is that the percentage of displaced fluid which returns as leakage from the high pressure side to the low pressure side of the machine reduces, and this gives a corresponding increase in efficiency and hence reduced operating fluid temperature.

Increasing the displacement volume of the machine for a given size of overall chamber envelope also reduces the space occupied and weight of the machine which for road transport applications can be used for additional payload on the vehicle.

The benefit of eliminating the sharp edges of the rotor tips is that erosion effects will not result in a reduction of performance over a period of time.

With sharp rotor tips which have not suffered erosion or other damage, there is little or no unsealing between the two rotors. However, if tip erosion takes place, then excess leakage will rapidly occur at a part of the compression cycle where there is high pressure in the valve rotor (FIG. 3; 9–11) area.

Rotors having a defined tip radius unseal when new but do so at a part of the compression cycle where the two rotor chambers combine the charge of fluid at a relatively low pressure, momentarily and therefore without undue losses.

The invention is described further hereinafter, by way of example only, with reference to the accompanying drawings.

DESCRIPTION OF THE PREFERRED EMBODIMENT

Figure 1:
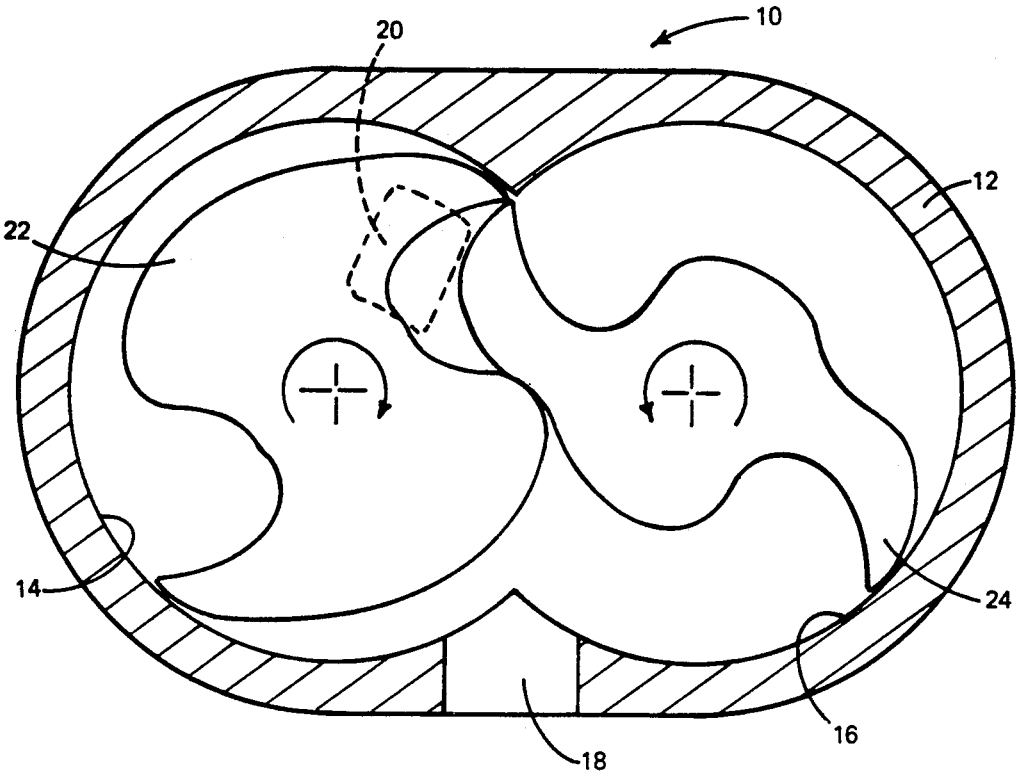
FIG. 1 is a diagrammatic end view of one embodiment of a rotary, positive displacement machine in accordance with the present invention, showing the displacement and valve rotors and the housing which defines the compression chamber.

Referring first to FIG. 1, the machine 10 has an outer housing 12 in which are formed a pair of parallel, cylindrical bores 14, 16 which partially overlap one another in the axial direction to form an internal cavity of generally "figure 8" peripheral profile. An inlet, low pressure port 18 is formed in the peripheral side wall of the housing 12 and an outlet, high pressure port or ports 20 is/are formed in the end wall(s) of the housing bore 14. A first, valve rotor 22 is rotatably mounted in the bore 14 for periodically opening and closing the high-pressure outlet port 20 as it rotates. A second, displacement rotor 24 is mounted in the bore 16 for synchronous rotation with the gate rotor 22.

The special constructional and performance characteristics of the present machine arise from the details of the complex, interdependent profiles of the valve and displacement rotors 22, 24 and these will now be described and defined with reference to FIGS. 2, 3, 4 and 5.

Figure 5:
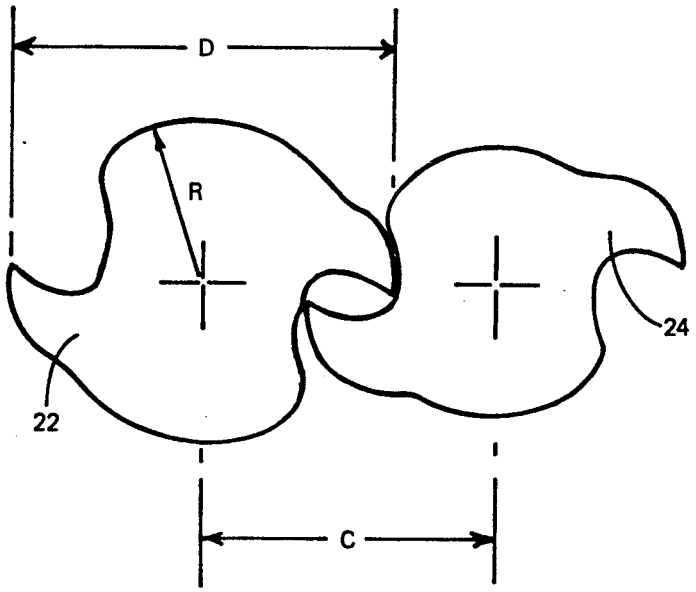
FIG. 5 is a diagram illustrating certain dimensions referred to in the description.

As illustrated in FIG. 5, the centre to centre spacing of the valve and displacement rotors 22, 24 is designated C, the maximum diameter of the rotors 22, 24 (corresponding substantially to the internal diameters of the bores 14, 16) is designated D and the radius of the valve rotor (which slightly exceeds the maximum radial extent of the high pressure outlet port(s) 20) is designated R.

Figure 3:
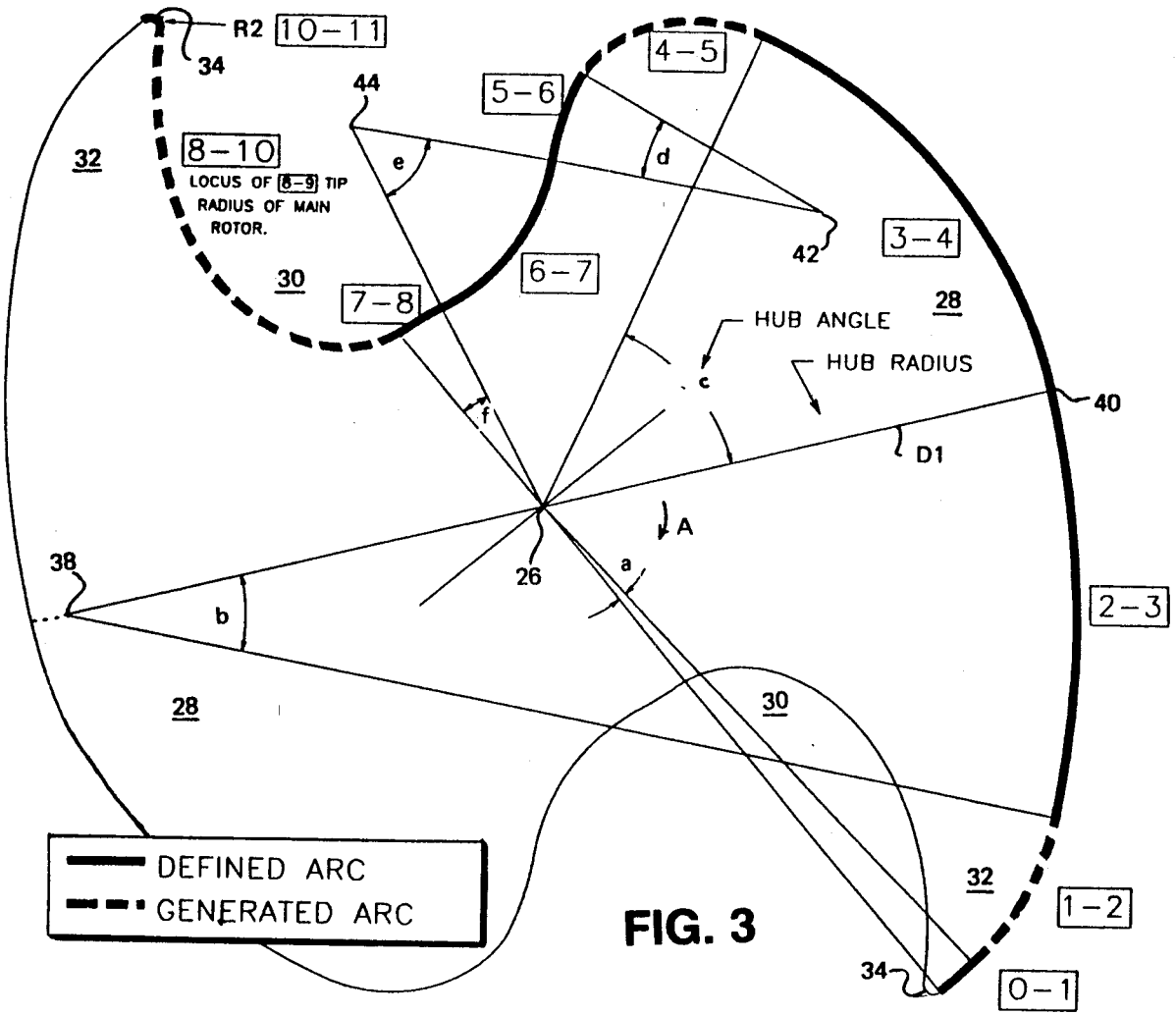
FIG. 3 is a line drawing showing the profile of the valve rotor of the machine of FIG. 1.
Figure 4A:
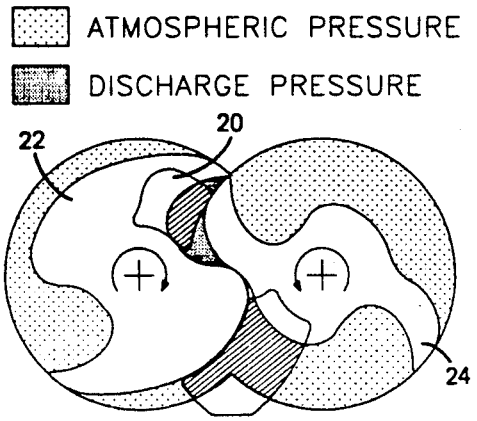
FIGS. 4*a* to 4*f* are diagrammatic end views illustrating the operational co-operation between the displacement and valve rotors through a cycle of relative positions.
Figure 4D:
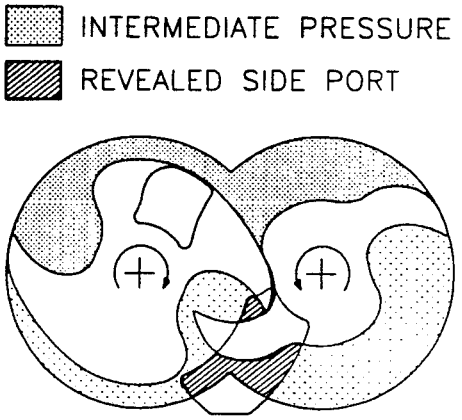
Figure 4B:
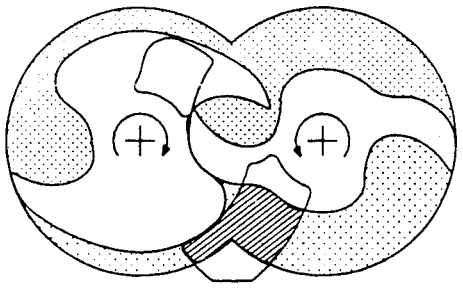
Figure 4E:
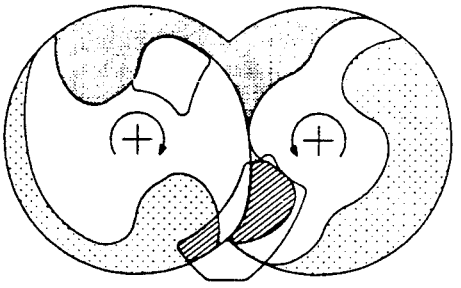
Figure 4C:
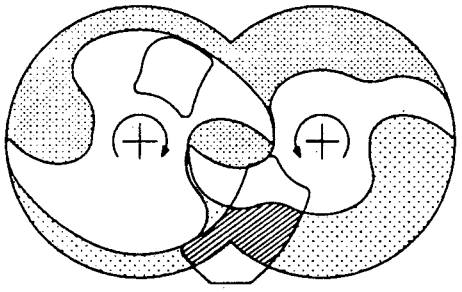
Figure 4F:
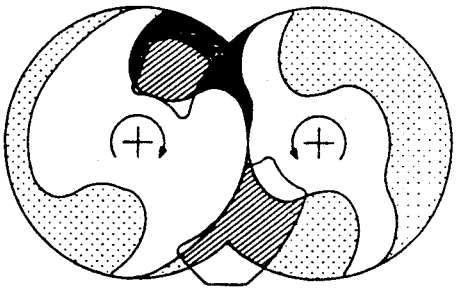

Considering first the valve rotor 22, see FIG. 3 in particular, this has an axis of rotation 26 about which it is rotated in the direction shown by the arrow A. The rotor 22 is symmetrical about any diameter and has two identical hub portions 28, two identical recessed portions 30 and two identical tip portions 32 disposed symmetrically about a diameter D.

Each tip portion 32 has a radiussed tip 34 and does not define a sharp edge in the manner adopted in prior art machines. By omitting such sharp edges, the tips 34 are more resistant to damage and wear and are therefore longer lasting. As explained further hereinafter, in order to enable radiussed tips to be incorporated whilst retaining satisfactory mating of the valve and displacement rotors, it is necessary for other corresponding surfaces on the co-operating rotor (in this case on the displacement rotor) to be generated using the locus of motion of these radiussed tips.

Extending rearwardly from the tips 34, the valve rotor has a first portion (0–1) extending over an angle a which is a true arc about the rotational axis 26.

Merging smoothly with arcuate portion (0–1) is a second portion (1–2) which is a non-arcuate, generated convex curve. At the junction of the portion (0–1) with the portion (1–2), the tangents to the respective curves is identical so as to obtain a smooth transference. The generation shape of the portion (1–2) is determined to achieve effective rolling (non-touching) co-operation with an arcuate portion (1–2) on the displacement rotor described further hereinafter.

Merging smoothly with the portion (1–2) of the valve rotor is an arcuate portion (2–3) of angle b whose centre of generation is disposed remote from the rotor axis 26 at a position 38. There is no discontinuity at the joint between the curves (1–2) and (2–3), the tangents to these curves being identical at the junction. The provision of the convex generated curve (1–2) followed directly by the arcuate curve (2–3) enables the ratio between rotor centres (C) and housing diameter (D) to be reduced beyond that of the prior art. The off-axis arcuate portion (2–3) merges smoothly with a portion (3–4) which is a true arc about the rotor axis 26 of angle c. Again, the tangents to the curves (2–3) and (3–4) are identical at their junction 40. The provision of the convex generated curve (1–2) followed directly by the off-axis arcuate curve (2–3) and then by the arcuate curve (3–4) enables the ratio between rotor centres (C) and housing diameter (D) to be reduced beyond that of the prior art. In the prior art exemplified by UK 2113767, the corresponding part of the valve rotor has a concavity connecting the tip portion to the main arcuate hub portion. The latter construction imposes a limitation of continuity of rotor profile (see FIG. 6*c*) as centres (C) are reduced for a given housing diameter (D).

Referring further to FIG. 3, the arcuate portion (3–4) of the valve rotor merges smoothly with a convex generated portion (4–5), followed by a convex arc (5–6) of angle d and centre 42, and then a concave arc (6–7) of angle e and centre 44. The corresponding portion of the known machine of UK 2113767 consists of two generated curves of opposite hand. Compared to the latter structure, the present arrangement enables closer spacing C of the rotor axes and therefore greater displacement volume for a given size of the overall envelope of the compression chamber.

The concave arcuate portion (6–7) is followed by a convex arcuate portion (7–8) of angle f which in turn is followed by a generated portion (8–10) coresponding to the locus of the tip (8–9) of the displacement rotor. The generated portion (8–10) is followed by the radiussed tip (10–11) of the valve rotor.

Thus the valve rotor 22 is constructed such that each lobe (32) has a leading flank, a portion (1–2) of which is a convex curve, which is generated to correspond to the form of the tip (8–9) of the second rotor (24) and which merges with a convex arcuate portion (2–3) whose centre (38) is offset from the first rotor axis (26); and such that each lobe (32) has a trailing flank formed by a convex curve (4–5), generated to correspond to the form of the tip (8–9) of the second rotor (24), which merges with a convex arcuate portion (5–6), whose centre (42) is offset from the first rotor axis (26), followed directly by a concave arcuate portion (6–7) whose centre (44) is also offset from the first rotor axis (26). The convex arcuate portion (2–3) merges directly with a convex arcuate portion (3–4) which itself merges directly with the convexly curved portion (4–5). The convexly curved portion (1–2) merges directly with a convex arcuate portion (0–1) which itself merges directly with the radiussed tip portion (34). The concave arcuate portion (6–7) merges directly with a convex arcuate portion (7–8) which itself merges with a complex curved portion (8–10) generated to correspond to the form of the tip (8–9) of the second rotor (24).

Thus, all portions of the valve rotor are true arcs except portions (1–2), (4–5) and (8–10).

Turning now to the displacement rotor 24 (see FIG. 2), this has a first portion (0–1) in the form of a true convex arc of angle g leading to a second portion in the form of a true concave arc of angle h and centre at 46. Arcuate portion (1–2) merges smoothly with a convex generated curve (2–3) whose shape is determined by the convex arcuate portion of the valve rotor which merges with the outer flank of the valve rotor 22. The tangents to the curves (2–3) and (1–2) at their junction 48 are identical to achieve a smooth changeover. In the corresponding region of the displacement rotor in the prior art, the sharp change in rotor form is due to the loss of arc space caused by accommodating a concave form at (2–3) on the valve rotor.

Generated convex portion (2–3) merges smoothly with a portion (3–4) which is a true convex arc of angle i about the rotor axis. This is followed by a true concave arc (4–5) of angle j whose centre is off-axis at 50. The arcuate portion (4–5) is followed by generated convex portions (5–6) and (6–7), and then by a true arc (7–8) of angle l about the rotor axis. The latter portion leads to a radiussed tip portion (8–9). Finally, the tip portion is coupled to a concave generated portion (9–11) whose shape follows the locus of the tip (10–11) of the valve rotor.

Referring now to FIGS. 5 and 6*a*–6*f*, in order to achieve the requirement that displacement volume is to be increased for a given size of overall compression chamber envelope, two conditions are being sought.

Firstly, the ratio $$\frac{C}{D} = \frac{\text{rotor centres}}{\text{rotor diameter}}$$

is to be reduced as far as possible.

Secondly, the ratio $$\frac{R}{D} = \frac{\text{rotor hub radius}}{\text{rotor diameter}},$$

which is a function of air flow restriction during the compression cycle, is to be optimised. The restriction arc between rotor radius R and housing radius D/2 must not be too small as fluid must transfer from one rotor/bore pocket to another (FIGS. 4a–4e) with minimum pressure loss. In conflict with this requirement, the ratio R/D should be maximised to increase port opening area as rotor radius R governs the outer radius of the ports.

Figure 6A:
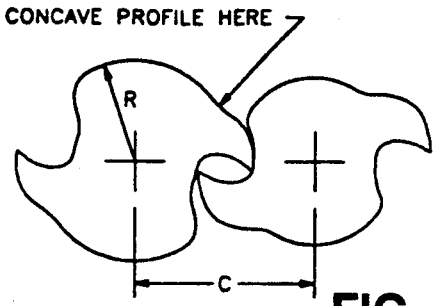
FIGS. 6*a* to 6*f* are a series of diagrams comparing certain characteristics of the present machine with those of the prior art.
Figure 6B:
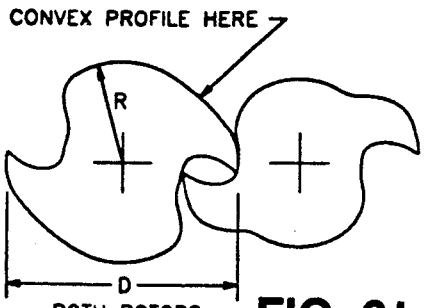

FIGS. 6a and 6b show the prior art and the present machine in the case where the ratios are $$\frac{C}{D} = 0.76 \text{ and } \frac{R}{D} = 0.4136$$

Both profiles are mathematically correct at this C/D ratio, and also at higher values.

Figure 2:
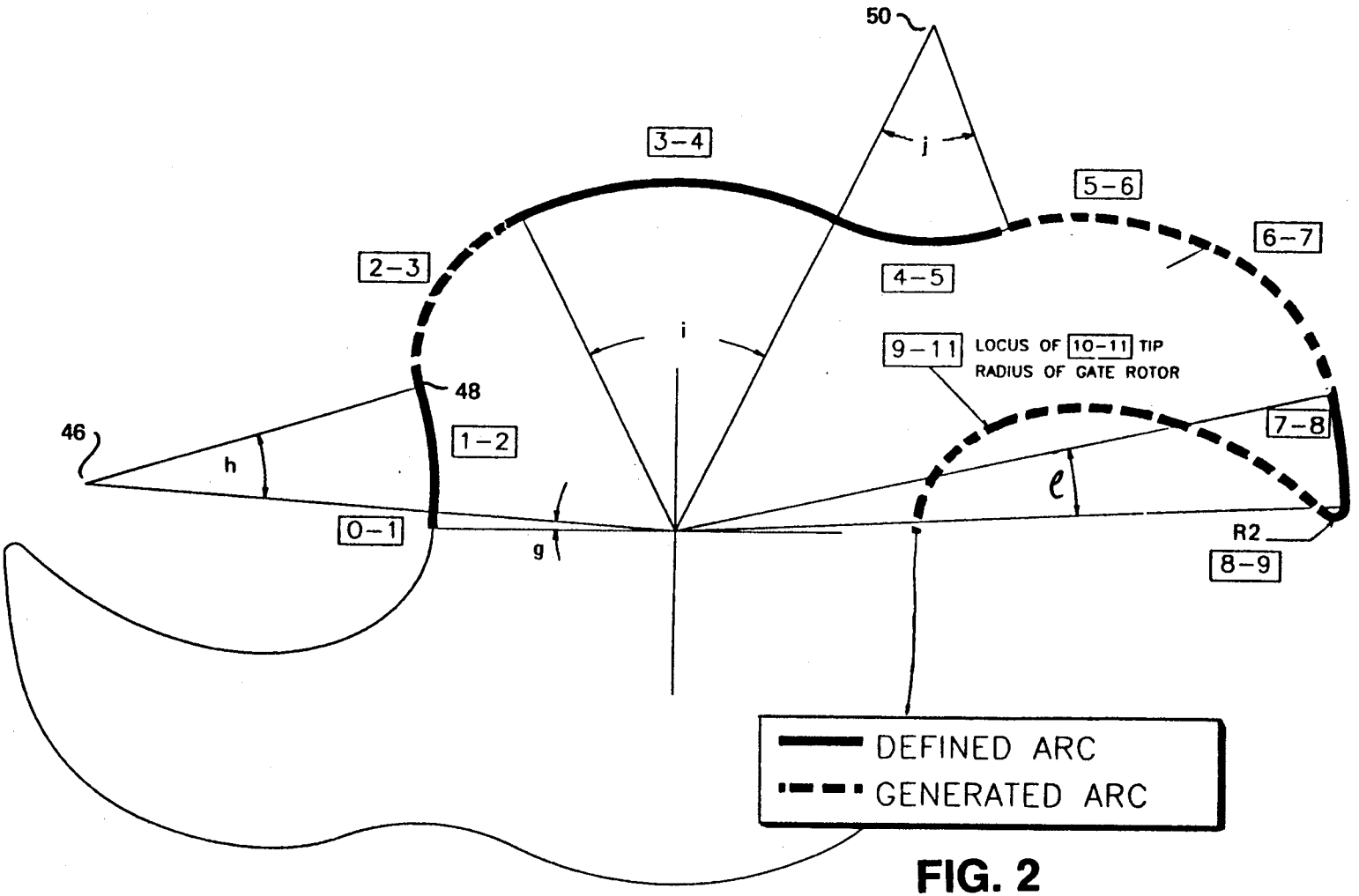
FIG. 2 is a line drawing showing the profile of the displacement rotor of the machine of FIG. 1.
Figure 6C:
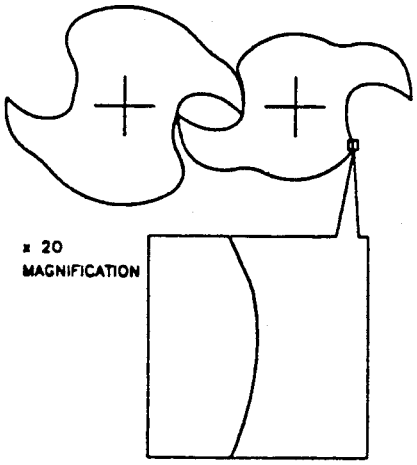
Figure 6D:
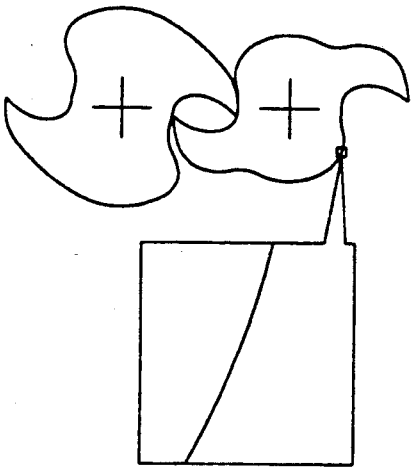

FIGS. 6c and 6d show the situation at a location X on the displacement rotor corresponding to the generated portion (2–3) in FIG. 2, when the ratio C/D has been reduced to 0.72. The ratio R/D remains at 0.4136. Although both profiles are still mathematically correct in the magnified region, the C/D ratio is near to its mathematical limit in the prior art machine.

Figure 6E:
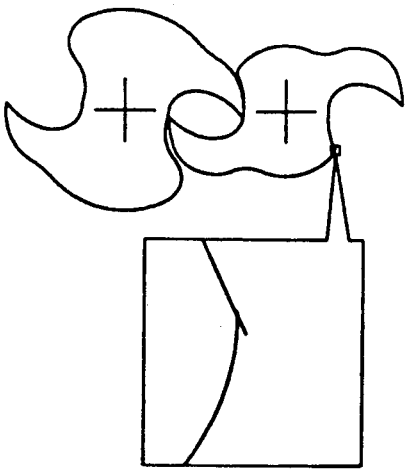
Figure 6F:
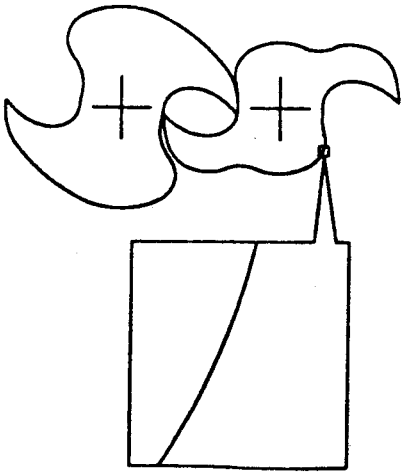

FIGS. 6e and 6f show the situation at the location X when the C/D ratio has been reduced to 0.68, the ratio R/D remaining at 0.4136. It can be seen from FIG. 6e that the profile of the prior art machine has become disjointed and is no longer a smoothly continuous curve. This would result in practice in the rotors clashing or unsealing. It will be noted that the profile of the present machine (FIG. 6f) remains correct at this, and lower, C/D ratios.

A complete cycle of operation of the present valve and displacement rotors is illustrated in FIGS. 4a to 4f. A detailed description of these Figures is not deemed necessary.

The features described above contribute to achieving the stated objects of increasing displacement volume for a given chamber envelope, enabling sharp edges on the rotor tips to be eliminated and inlet and outlet port size to be optimised for a given rotor spacing. Furthermore, the large internal radii in the rotor profiles requires only the use of long edge spiral flute milling cutters of substantial diameter on a machining centre to produce rotors accurately of a substantial length. The relatively large internal radii defined on both rotors generate correspondingly large external curves on the flanks of the meshing rotor. This reduces internal gas throttling losses between the edge of the rotor and bore in which it rotates. The use of only large curves on the rotor flanks also serves to reduce gas slip from the high pressure chamber to the low pressure chamber, particularly at (2–3), (4–5) and (6–7). Finally, large curves on the rotor flanks suffer less from erosion when running at high speeds than sharp edges so that the useful life of the machine is increased.

I claim:

1. A rotary positive-displacement machine of the type having intermeshing lobed rotors, comprising:

a housing having two parallel cylindrical intersecting bores defined therewithin;

an inlet port communicating with said two bores for the introduction of low pressure fluid to the housing;

an outlet port formed in at least one end wall of the housing for the discharging of high pressure fluid from the housing;

first and second two-lobed rotors mounted respectively in the two bores for synchronous rotation;

said first rotor having a hub portion which periodically occludes said outlet port to control the generation and discharge of high pressure fluid from the housing;

each lobe of said first rotor having a leading tip portion which is radiussed so that it does not define a sharp edge;

each lobe of said first rotor having an outer flank, a portion of which is a first convex curve, which is generated to correspond to the form of the tip of the second rotor and which merges with a first convex arcuate portion whose centre is offset from the first rotor axis; and each lobe having a trailing flank formed by a second convex curve, generated to correspond to the form of the tip of the second rotor, which merges with a second convex arcuate portion, whose centre is offset from the first rotor axis, followed directly by a concave arcuate portion whose centre is also offset from the first rotor axis.

2. A machine according to claim 1 wherein said first convex arcuate portion merges directly with a third convex arcuate portion which itself merges directly with said second convexly curved portion.

3. A machine according to claim 1, wherein said first convexly curved portion merges directly with a third convex arcuate portion which itself merges directly with said radiussed tip portion.

4. A machine according to claim 1, wherein said concave arcuate portion merges directly with a fourth convex arcuate portion which itself merges with a third convex curved portion generated to correspond to the form of said tip of the second rotor.

* * * * *